US008425207B2

(12) United States Patent
Lee

(10) Patent No.: US 8,425,207 B2
(45) Date of Patent: Apr. 23, 2013

(54) MOTOR DRIVEN AIR COMPRESSOR AND HYDRAULIC PUMP MODULE

(75) Inventor: Donggeun Lee, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 250 days.

(21) Appl. No.: 12/950,906

(22) Filed: Nov. 19, 2010

(65) Prior Publication Data

US 2012/0076676 A1 Mar. 29, 2012

(30) Foreign Application Priority Data

Sep. 27, 2010 (KR) ..... 10-2010-0093072

(51) Int. Cl.
*F16H 55/56* (2006.01)

(52) U.S. Cl.
USPC ..... 417/362; 474/8

(58) Field of Classification Search ..... 417/362; 474/8

See application file for complete search history.

(56) References Cited

U.S. PATENT DOCUMENTS 4,619,587 A * 10/1986 Linnig ..... 417/319
7,690,451 B2 * 4/2010 Chiao ..... 180/53.5
2006/0091730 A1 * 5/2006 Chiao ..... 307/10.1
2007/0155551 A1 * 7/2007 Luedtke ..... 474/8

FOREIGN PATENT DOCUMENTS

| | | |
|---|---|---|
| JP | 56-160214 | 12/1981 |
| JP | 09-060596 A | 3/1997 |
| JP | 9-109664 | 4/1997 |
| JP | 09-267647 A | 10/1997 |
| JP | 2003-007324 A | 1/2003 |
| JP | 2008-285028 | 11/2008 |
| KR | 10-2000-0040476 | 7/2000 |

* cited by examiner

*Primary Examiner* — Charles Freay
*Assistant Examiner* — Patrick Hamo
(74) *Attorney, Agent, or Firm* — Edwards Wildman Palmer LLP; Peter F. Corless

(57) ABSTRACT

The present invention provides a motor driven air compressor and hydraulic pump module that makes it possible to adjust the operational speed of the air compressor in accordance with the operational conditions of the air compressor, prevent shock and water from being produced in an air pipe connected to the air compressor by preventing sudden connection/disconnection of torque transmitted from the motor to the air compressor, by using a continuously variable transmission, thereby improving durability of the motor and the air compressor.

4 Claims, 4 Drawing Sheets

MOTOR DRIVEN AIR COMPRESSOR AND HYDRAULIC PUMP MODULE

CROSS-REFERENCE TO RELATED APPLICATIONS

The present application claims priority to Korean Patent Application Number 10-2010-0093072 filed Sep. 27, 2010, the entire contents of which application is incorporated herein for all purposes by this reference.

BACKGROUND OF THE INVENTION

1. Field of the Invention

The present invention generally relates to a motor driven air compressor and hydraulic pump module for vehicles, and more particularly, a mechanism that makes it possible to operate an air compressor and a hydraulic pump with one motor under each operational condition.

2. Description of Related Art

FIG. 1 shows a motor driven air compressor and a hydraulic pump module which are configured to operate a hydraulic pump 502 for a power steering system and an air compressor 504 that compresses air, using one motor 500.

As shown, the hydraulic pump 502 is directly connected to the rotary shaft of motor 500 and the air compressor 504 is connected to motor 500 by a clutch 506, a pulley 508, and a belt 510.

As such, torque from the motor 500 is transmitted to the air compressor 504 through the belt 510, by connection/disconnection of the clutch 506.

Therefore, the air compressor 504 functions by cutting the power from the motor 500 to the belt 510 by disconnecting the clutch 506 when operation of the air compressor 504 is not needed, and operating or connecting the clutch 506 to transmit the power from the motor 500 to the belt 510 when operation of the air compressor 504 is required.

However, in the structure described above, the gear ratio of the clutch 506 and pulley 508 is fixed to a predetermined level, such that the rotational speed of air compressor 504 cannot be adjusted, but rather only the on/off states can be provided.

Further, according to this structure, since transmission of torque to the air compressor 504 is controlled by the clutch 506, the air compressor 504 is thus suddenly connected/disconnected to/from the motor 500 which rotates at high speed by load. As such, both the motor 500 and air compressor 504 are likely to be damaged by sudden changes in torque.

Further, when the torque of the air compressor 504 is suddenly changed by the clutch 506, as described above, water may be produced in the pipe connected to the air compressor 504 by a sudden change in pressure.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

The present invention provides a motor driven air compressor and hydraulic pump module which can adjust the operational speed of the air compressor in accordance with the operational conditions of the air compressor, and prevents shock and water from being produced in the air pipe connected to the air compressor by preventing sudden connection/disconnection of torque transmitted from a motor to the air compressor, thereby improving durability of the motor and the air compressor.

An exemplary embodiment of the present invention provides a motor driven air compressor and hydraulic module which includes a motor, a hydraulic pump driven by torque transmitted from the motor, an air compressor driven by the torque transmitted from the motor, and a transmission disposed between the motor and the air compressor, particularly between the rotary shaft of the motor and the rotary shaft of the air compressor, so as to continuously change and transmit the rotation of the motor to the air compressor.

According to preferred embodiments of the present invention, it possible to adjust the operational speed of the air compressor in accordance with the operational conditions of the air compressor. It is further possible to prevent shock and water from being produced in the air pipe connected to the air compressor by preventing sudden connection/disconnection of torque transmitted from a motor to the air compressor, and thereby prevent damage to the motor and the air compressor.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
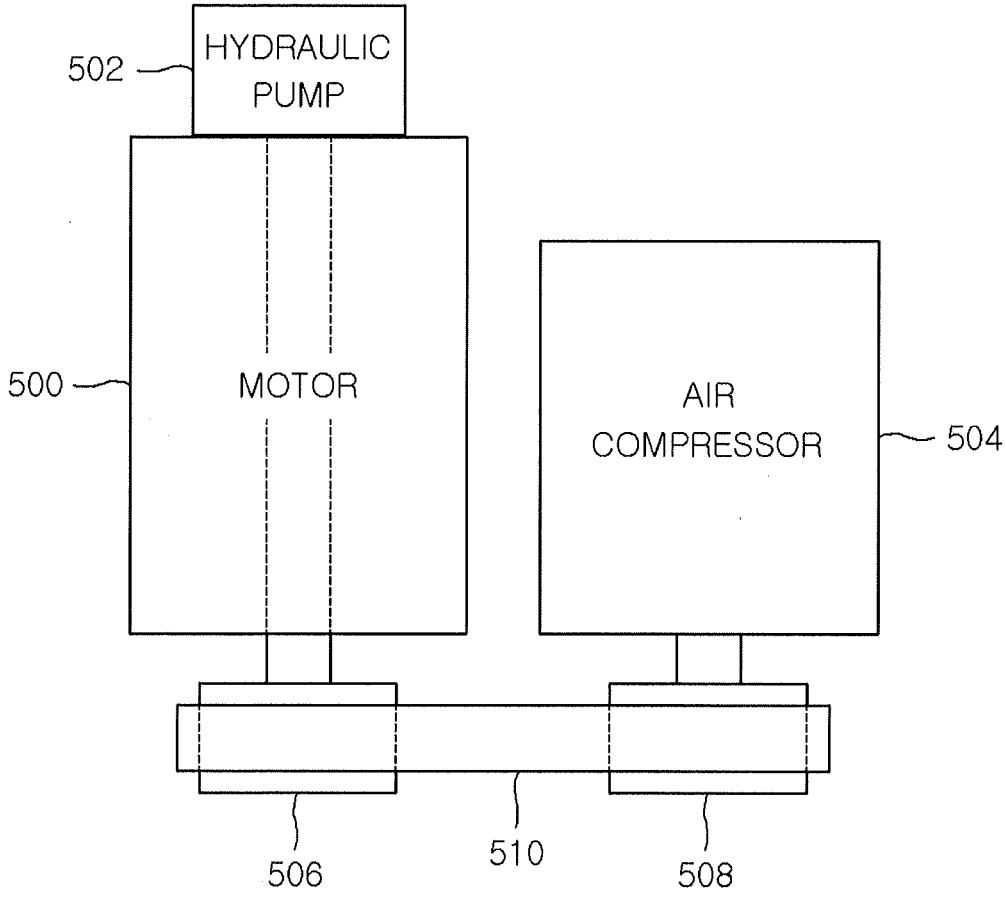
FIG. 1 is a view illustrating the structure of a motor driven air compressor and a hydraulic pump module according to the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
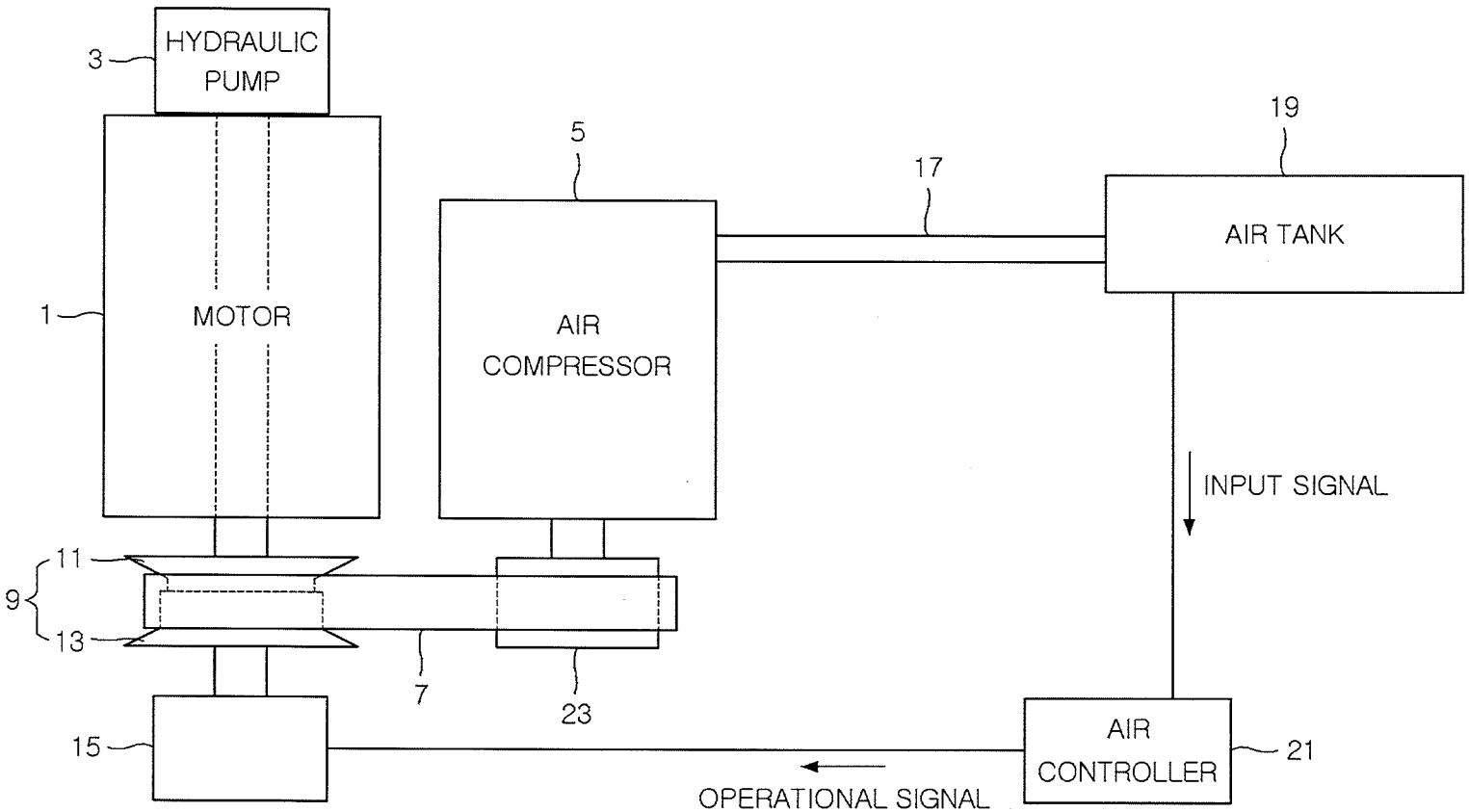
FIG. 2 is a view illustrating the structure of a motor driven air compressor and a hydraulic pump module according to an exemplary embodiment of the present invention.

Referring to FIG. 2, an exemplary embodiment of the present invention includes: a motor 1; a hydraulic pump 3 driven by torque transmitted from motor 1; an air compressor 5 driven by the torque transmitted from motor 1; and a transmission disposed between the rotary shaft of motor 1 and the rotary shaft of air compressor 5. In accordance with preferred embodiments, the transmission is configured and disposed so as to continuously change and transmit the rotation of the motor 1 to the air compressor 5.

The transmission can be in accordance with any known transmissions, and preferably is a continuously variable transmission. In particular, the air compressor 5 is configured so as to operate at different speeds with respect to the rotational speed of motor 1 and so as to operate within a predetermined range by the continuously variable transmission. As such, when torque is transmitted from the motor to operate the air compressor 5, operation of the air compressor 5 can be controlled and the control can be smoothly and continuously changed by varying the speed ratio of the motor 1 and the air compressor 5.

As shown in FIG. 2, the hydraulic pump 3 is directly connected to the rotary shaft of the motor 1. As such, the hydraulic pump directly receives torque from the motor 1, such that the motor 1 operates basically in accordance with the operational objects of the hydraulic pump 3.

In accordance with the embodiment shown in FIG. 2, the continuously variable transmission includes a belt 7 and a variable pulley unit 9. As shown, the belt 7 is provided between the rotary shaft of the motor 1 and the rotary shaft of the air compressor 5, and a variable pulley unit 9 is mounted on at least one of the rotary shafts of the motor 1 and the air compressor 5. In this embodiment, the variable pulley unit 9 is configured and arranged to change the contact radius from the belt 7.

As further shown in FIG. 2, the variable pulley unit 9 can be composed of a fixed pulley 11, a movable pulley 13, and a pulley actuator (not shown). The distance between the fixed pulley 11 and the movable pulley 13 can be adjusted by moving the movable pulley 13, (e.g. moving straight in direction of the rotational axis). In a preferred embodiment, the pulley actuator moves the movable pulley 13 straight with respect to fixed pulley 11 so as to adjust the distance between the fixed and movable pulleys 11/13. In this exemplary embodiment, the fixed pulley 11 is fixed to the rotary shaft of the motor 1. However, the fixed pulley can be otherwise fixed in accordance with known methods. The pulley actuator 15 can be in accordance with any known pulley actuators, and in a preferred embodiment, the pulley actuator is a step motor 1 in connection with the movable pulley 13.

As shown in the embodiment of FIG. 2, the air compressor 5 is in connection with an air tank 19, such as through an air line 17, to produce and send out compressed air. A controller 21 can further be provided for controlling the motor 1 in response to the pressure conditions of the air tank 19.

As shown in FIG. 2, the continuously variable transmission is mounted to the rotary shaft of the motor 1, and a simple pulley 23 (for example, one of which the contact radius of the wound belt 7 does not change) is further mounted on the rotary shaft of the air compressor 5. In a preferred embodiment, the belt 7 is a V-belt having a V-shape cross-section to easily ensure a sufficient contact area with the fixed pulley 11 and the movable pulley 13 so as to transmit power even if the distance between the fixed pulley 11 and the movable pulley 13 changes.

In this embodiment, it is preferable that the tensile force of the belt 7, which changes by means of movement of the movable pulley 13 as described above, is maintained by a tensioner which can be disposed around the belt 7. The tensile force of the belt 7 can further be continuously maintained at a predetermined level by using a variable pulley mechanism (for example, similar to the variable pulley unit 9 described in connection with the motor 1) also in the air compressor 5 that complementarily operates with the variable pulley unit 9 in the motor 1.

Figure 3:
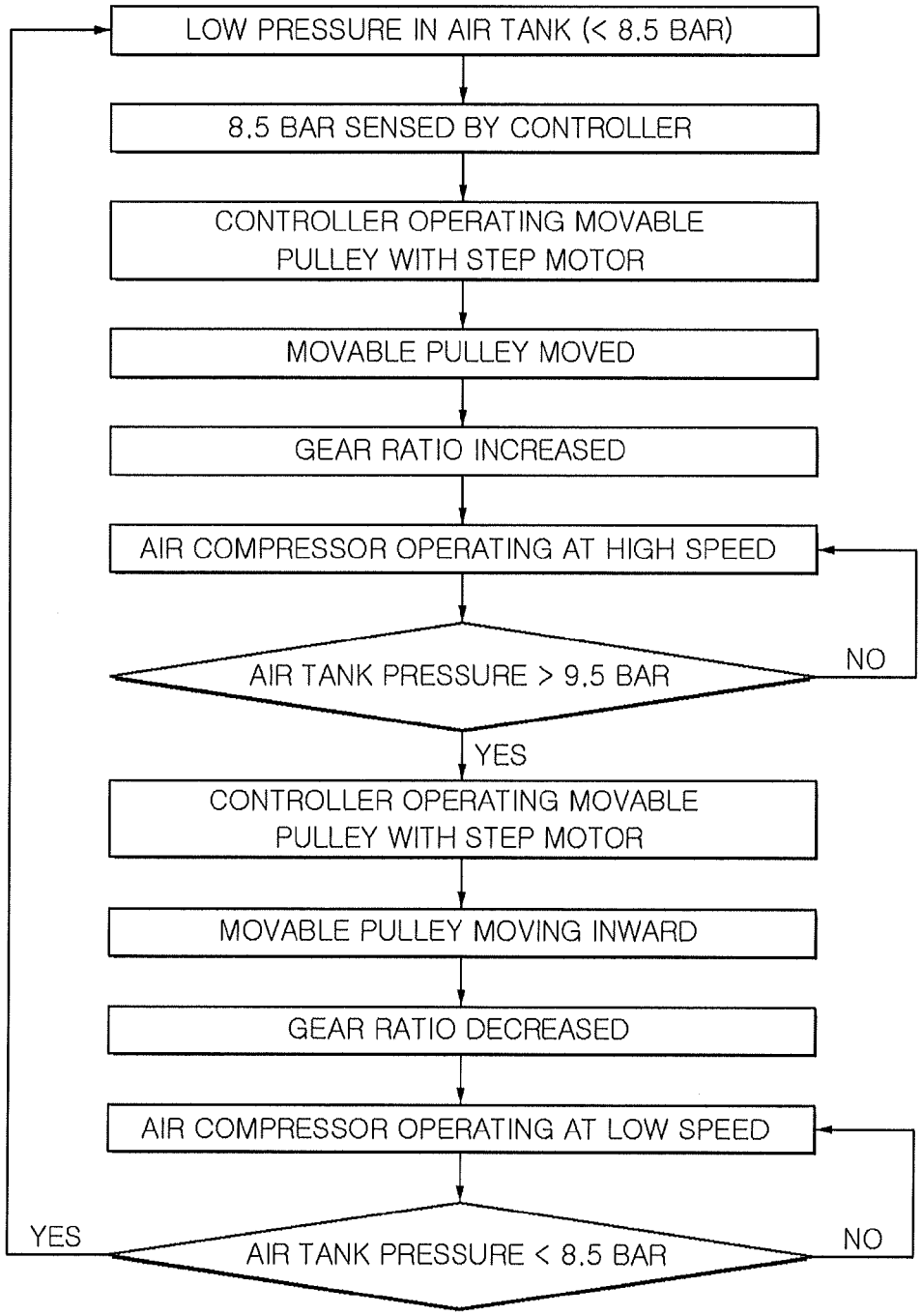
FIG. 3 is a flowchart illustrating the operation of a motor driven air compressor and a hydraulic pump module according to an exemplary embodiment of the present invention.
Figure 4:
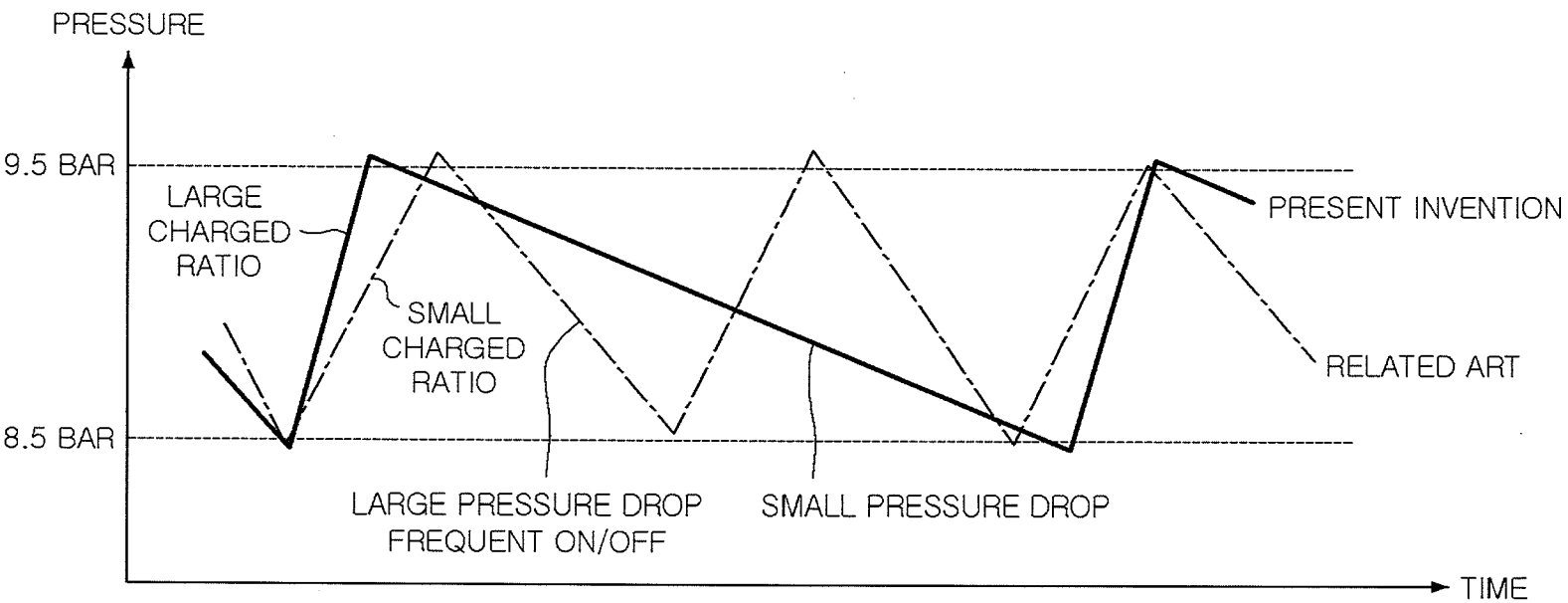
FIG. 4 is a graph comparing changes in operational pressure of air compressors to time, according to an exemplary embodiment of the present invention and the related art.

The operation of the motor driven air compressor and the hydraulic pump module having the above configuration according to the present invention is further described hereafter with reference to FIGS. 3 and 4.

For example, assuming that appropriate pressure of the air tank 19 is in the range of 8.5 bar and 9.5 bar, when the pressure of the air tank 19 becomes less than 8.5 bar, the controller 21 senses the pressure and operates the pulley actuator (which can be the step motor 1 in certain preferred embodiments) such that movable pulley 13 is separated from fixed pulley 11.

As the distance between movable pulley 13 and fixed pulley 11 increases, the contact area between the belt 7 and the movable pulley 13 and the fixed pulley 11 deceases, and the contact radius at the pulley 23 mounted on the rotary shaft of the air compressor 5 remains constant, such that the gear ratio changes and the air compressor 5 operates at high speed. Accordingly, the pressure of the air tank 19 increases.

In this operation, the increase in the pressure of the air tank 19 is in proportion to the displacement of the movable pulley 13. Therefore, it is possible to rapidly increase the pressure of the air tank 19 by increasingly moving the movable pulley 13. Thus, as demonstrated in FIG. 4, it is possible to more rapidly increase the pressure in comparison to a conventional configuration which uses a simple clutch.

As further shown in FIG. 3, when the pressure of the air tank 19 exceeds 9.5 bar by the operation described above, the controller 21 operates the pulley actuator (e.g. a step motor 1) and the movable pulley 13 starts to move toward the fixed pulley 11.

Accordingly, the gear ratio for the power transmitted from the motor 1 to the air compressor 5 changes and the air compressor 5 starts rotating at a relatively low speed.

As this occurs, the pressure of the air tank 19 slowly drops as shown in FIG. 4, such that condensation of water is remarkably reduced as compared with conventional systems in which power transmitted to the air compressor is suddenly and completely cut. Further, according to the present system and method, shock is prevented from being transmitted to the motor 1 or the air compressor 5. Further, since the controller 21 slowly moves the movable pulley 13 towards the fixed pulley 11, the pressure of the air tank 19 slowly drops, and it is not required to frequently operate the movable pulley 13.

As shown in FIG. 4, the pressure of the air tank 19 is maintained at a predetermined level by repeating the control steps described above. Thus, according to the present invention, it is possible to considerably reduce the number of times that the movable pulley 13 must be operated in comparison to the number of times that the clutch must be connected/disconnected in prior systems. Further, according to the present system and method, the power is not completely cut or connected, and it is thus possible to improve durability while preventing shock from being transmitted to the motor 1 and the air compressor 5.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A motor driven air compressor and hydraulic pump module comprising:

a motor;

a hydraulic pump driven by torque transmitted from the motor;

an air compressor driven by torque transmitted from the motor; and a continuously variable transmission configured and arranged to continuously change and transmit rotation of the motor to the air compressor, wherein the continuously variable transmission includes a belt and a variable pulley unit mounted on at least one rotary shaft of the motor and the air compressor to change a contract radius of the belt, the variable pulley unit includes a fixed pulley fixed to the at least one rotary shaft, a movable pulley, and a step motor connected to the movable pulley, the step motor configured and arranged to move the movable pulley straight with respect to the fixed pulley to adjust a distance between the fixed pulley and the movable pulley.

2. The motor driven air compressor and hydraulic pump module of claim 1, wherein the hydraulic pump is directly connected to the rotary shaft of the motor to receive torque from the motor.

3. The motor driven air compressor and hydraulic pump module of claim 1, wherein the air compressor is in connection with an air tank through an air line, wherein the air compressor is configured to produce and send compressed air to the air tank, and wherein the air tank is provided with a controller configured and arranged to control the step motor in response to pressure conditions of the air tank.

4. The motor driven air compressor and hydraulic pump module of claim 3, wherein a simple pulley is mounted on the rotary shaft of the air compressor, wherein the simple pulley is configured and arranged such that the contact radius of the belt does not change, and wherein the belt is a V-belt.

* * * * *